United States Patent [19]

Siecke et al.

[11] Patent Number: 4,607,483

[45] Date of Patent: Aug. 26, 1986

[54] METHOD AND APPARATUS FOR TWISTING AND ADVANCING STRAND MATERIAL

[75] Inventors: Albert E. Siecke, Westfield, N.J.; Edward Janos, New York, N.Y.

[73] Assignee: Warner-Lambert Company, Morris Plains, N.J.

[21] Appl. No.: 718,586

[22] Filed: Apr. 1, 1985

[51] Int. Cl.[4] ..... D02G 1/08; D07B 3/00

[52] U.S. Cl. ..... 57/334; 57/1 R; 57/285; 57/311; 57/314; 57/332; 264/103

[58] Field of Search ..... 57/1 R, 59, 284, 285, 57/332, 334, 335, 338, 314, 311; 264/103

[56] References Cited

U.S. PATENT DOCUMENTS 2,673,442 3/1954 Long ..... 57/334

3,067,461 12/1962 Hughey ..... 57/334 X 3,327,461 6/1967 Wyatt ..... 57/284

3,457,338 7/1969 LeFevre ..... 264/103

*Primary Examiner*—John Petrakes

*Attorney, Agent, or Firm*—Howard Olevsky; Gary M. Nath

[57] ABSTRACT

This invention relates to a conveyor means for simultaneously advancing and twisting a plurality of strands into a rope and the process for utilizing these means. The conveyor includes an elongated trough with two walls which are joined to define the linear path. The first wall includes the plurality of aligned rollers having access of rotating with a predetermined angular relationship relative to horizontal and vertical planes as well as a power means for driving the rollers in unison and means for feeding the strands into the trough and in frictional contact with the rollers.

20 Claims, 6 Drawing Figures

11
12
13
14
15
16
17
18
19
20
21
21'
22
22'
23
23'
24
24'
25
25'
31
32
33
34
35
36
37
38
39
40
41
42
M
M1
S
1
2
3

14'
15'
16'
17'
18'
26
27
28
29
34
35
40
S

METHOD AND APPARATUS FOR TWISTING AND ADVANCING STRAND MATERIAL

BACKGROUND OF THE INVENTION

The present invention relates to strand material and relates in particular to twisting at least two strands advancing continuously from a source of strands.

Prior art stranding machines usually involve reels of strand material whirling about horizontal or vertical axes.

Such machines have large space requirements and need extensive guards and shields to protect operators from the whirling mass.

SUMMARY OF THE INVENTION

In contrast, it is a prime feature of the present invention to provide a simplified apparatus and method for twisting a plurality of strands into a rope or cable in continuous fashion.

A further feature of the invention is the provision of an apparatus and a method for twisting strands into a rope while individual strands advance continuously from a source such as an extruder or a supply reel or the like where there is no requirement to rotate one strand source about the other, i.e., the strand sources remain secured to a fixed support and merely "pay out" strand material in continuous, generally parallel fashion.

A still further feature of the invention is the provision of a conveyor means in the form of a trough for twisting and advancing a plurality of strands along a substantially linear path, said trough having at least one side wall formed with a series of aligned (parallel) rollers and each roller having a rotational axis disposed in a predetermined angular relationship relative to horizontal and vertical planes. Power means are provided for rotating the rollers in unison in a predetermined direction so that a plurality of advancing strands in frictional contact with said rollers are influenced by at least two components of force, a first force component tending to continue the advance of the strands and a second force component tending to rotate (twist) the strands into a rope.

A method of twisting a plurality of strands into a rope configuration embracing certain principles of the present invention may comprise the steps of providing a conveyor means having at least two side walls, one side wall including a series of side-by-side rollers, skewing a rotational axis of each roller in a predetermined angular position, rotating the rollers about their axes in a predetermined direction, feeding said strands into said trough and into frictional contact with said rollers whereby the rollers by virtue of their skewed disposition and direction of rotation are effective to twist the strands into a rope while continuing to advance the twisted strands through the conveyor means.

An apparatus embracing certain features of the invention may comprise a conveyor means defining an elongated trough having at least two walls joined to define a linear path, a first wall including a plurality of aligned rollers having axes of rotation bearing a predetermined angular relationship relative to horizontal and vertical planes, power means for driving said rollers in unison in a predetermined direction, and means for advancing said strands into said trough and into frictional contact with said rollers, said rollers being effective, by virtue of their angular position and direction of rotation, to advance the strands while twisting the strands into a rope.

Other features and advantages of the present invention will become more apparent from an examination of the succeeding specification when read in conjunction with the appended drawings, in which;

DESCRIPTION OF THE PREFERRED EMBODIMENTS

Figure 1:
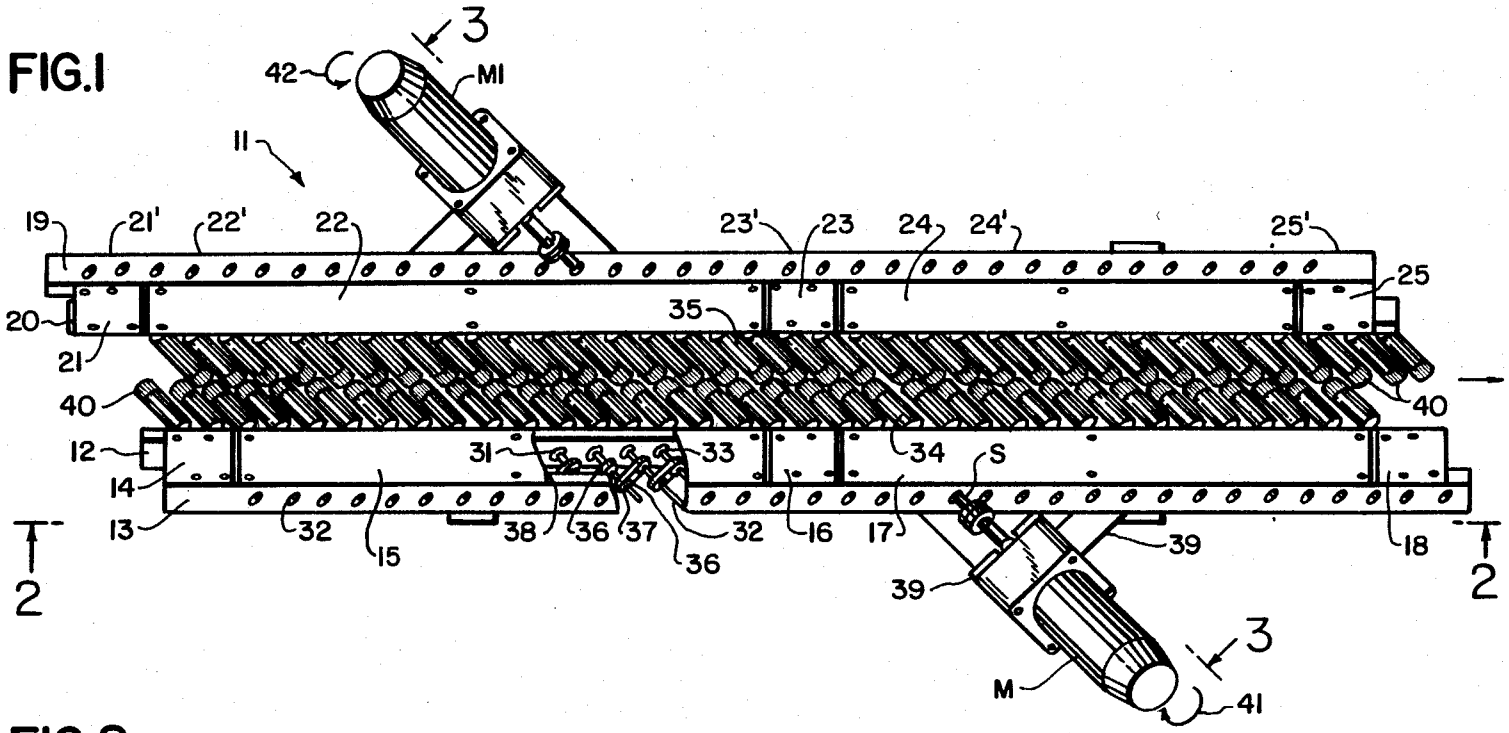
FIG. 1 is a plan view of a conveyor means illustrating the invention.
Figure 2:
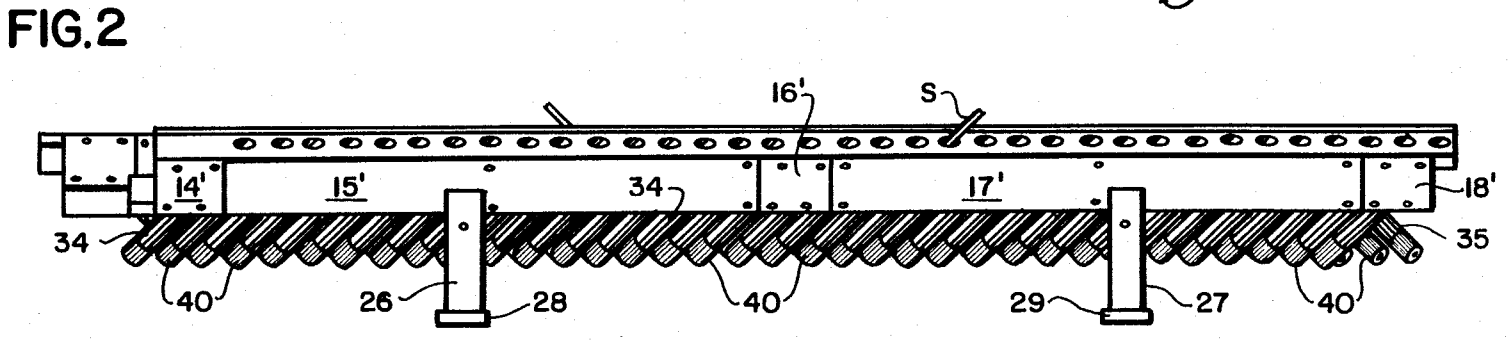
FIG. 2 is a side elevation of the illustration of FIG. 1.
Figure 3:
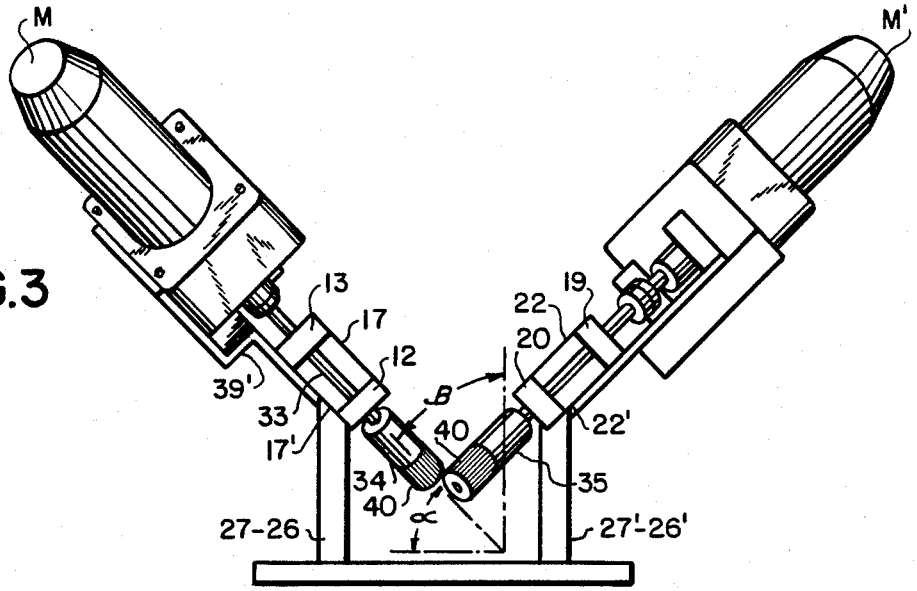
FIG. 3 is a sectional view along the staggered line labeled 3—3 in FIG. 1 observed in the direction of the arrows.

Referring to FIGS. 1, 2 and 3, the reference numeral 11 designates generally a conveyor means including two pairs of rails defining bearing blocks or bearing supports.

A first pair of bearing supports 12 and 13 are spaced apart by and secured to a series of side or cover plates 14, 15, 16, 17 and 18 on one side and by plates 14', 15', 16', 17' and 18' on the opposite side.

A second pair of bearing supports 19 and 20 are spaced apart by and secured to a corresponding series of side or cover plates 21, 22, 23, 24 and 25 on one side and by plates 21', 22', 23', 24' and 25' on the opposite side.

The side plates and, in turn, the bearing blocks are supported by legs 26 and 27 secured to flat plates 28 and 29 respectively.

Bearing supports 19 and 20 are constructed in the same fashion and for the same purpose as are the supports 12 and 13. Therefore, only bearing supports 12 and 13 will be described in detail with the understanding that a detailed description of one set of supports also describes the other set.

Bearing supports 12 and 13 are fitted with a plurality of bushings or sleeves 31 and 32 providing spaced bearings for shafts or spindles 33—33 in turn supporting mating rollers 34—34.

Suitably keyed to each spindle 33 are spaced sprockets 36 and 37. The sprockets 36 of one spindle are aligned with the sprockets 37 of the next adjacent spindle so that roller chains 38—38 make a driving connection from spindle to spindle when the chains are powered by main spindle S driven by motor M supported by angle bracket 39 in turn secured to leg 26 as is most apparent in FIGS. 1 and 3.

It is not intended that the means for driving the spindles be limited to sprocket and chain arrangements. Other suitable drives, such as V belts, friction pulleys and the like, may be employed as engineering and economic considerations dictate.

The rollers 34—34 and rollers 35—35, arranged side by side in generally parallel fashion, are formed at one end with a roughened or knurled peripheral surface 40 for a purpose which will become more apparent as this specification proceeds.

The rollers 34—34 are each skewed so that their respective rotational axes subtend predetermined angles relative to horizontal and vertical planes which for purposes of explaining the invention develop an included angle alpha $\alpha$ with a horizontal plane and an included angle beta $\beta$ with a vertical plane as shown in FIG. 3.

While the values of alpha and beta are 45 degrees and 45 degrees, respectively, in the disclosed embodiment of the invention, it is not intended that the invention be limited to these values. Considerations of desired pitch and included angle of the V-shaped cross-section require adjustment in these angles from time to time.

The skewed rollers 34—34 and 35—35 having knurled ends 40 are spaced apart slightly (as shown in FIG. 3). The rollers form the side walls of the conveyor means 11 and present a generally V-shaped configuration in cross-section. The apex or bottom of the V defines a generally linear path P.

Each set of rollers is driven (rotated) by respective motors M and M' in the direction indicated by circular arrows 41 and 42 of FIG. 1. Rotation of the rollers in a given direction in combination with the skewed disposition of their axes of rotation (rollers 34—34, for example) is effective to develop two components of force influencing an elongate article (not shown) cradled in the V of the conveyor means.

That is, rotating the rollers 34—34 in the direction of arrow 41 develops two force components. One component of force is effective to move said elongate article through the conveyor and a second component of force is effective to rotate the article as it moves forward along path P.

Thus, it can be seen that the conveyor means of the present invention is operative and effective to twist and advance a plurality of strands into a rope continuously.

Further, it can be appreciated that a plurality of generally parallel strands advancing into the left end of the conveyor means of FIG. 1 at an appropriate linear speed (while the rollers 34—34 are rotating driven by motor M) will continue advancing in the conveyor means while the strands are twisted (rotated) into a rope of a uniform lay and pitch.

In fact, while the side walls of the disclosed conveyor means 11 comprise two sets of driven rollers 34—34 and 35—35, it is entirely within the scope of the method and apparatus of the present invention to permit one set of rollers to idle, i.e., drive only one set of rollers and remain effective to twist and advance strands.

Furthermore, one set of rollers may be replaced by a smooth, relatively friction-free, plate of plastic or metallic sheet material so that the side walls define one set of driven rollers cooperating with a smooth sheet together generating said V-shaped configuration in cross-section.

Figure 6:
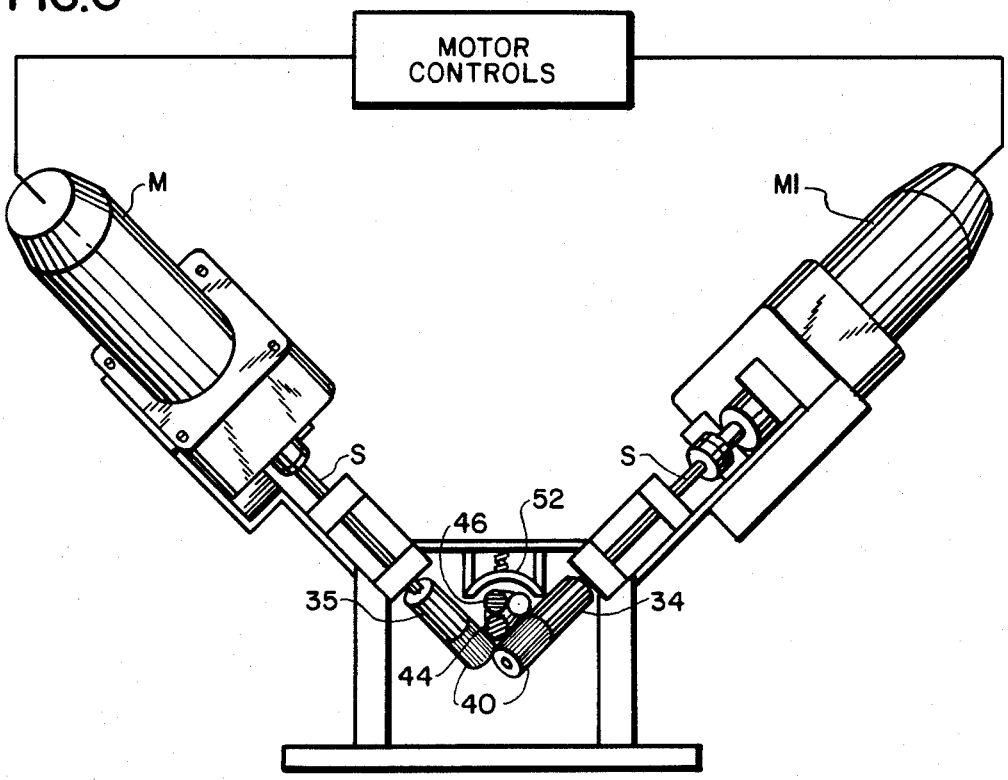
FIG. 6 is a sectional view similar to FIG. 3 showing three strands twisting and advancing in the second conveyor means.
Figure 4:
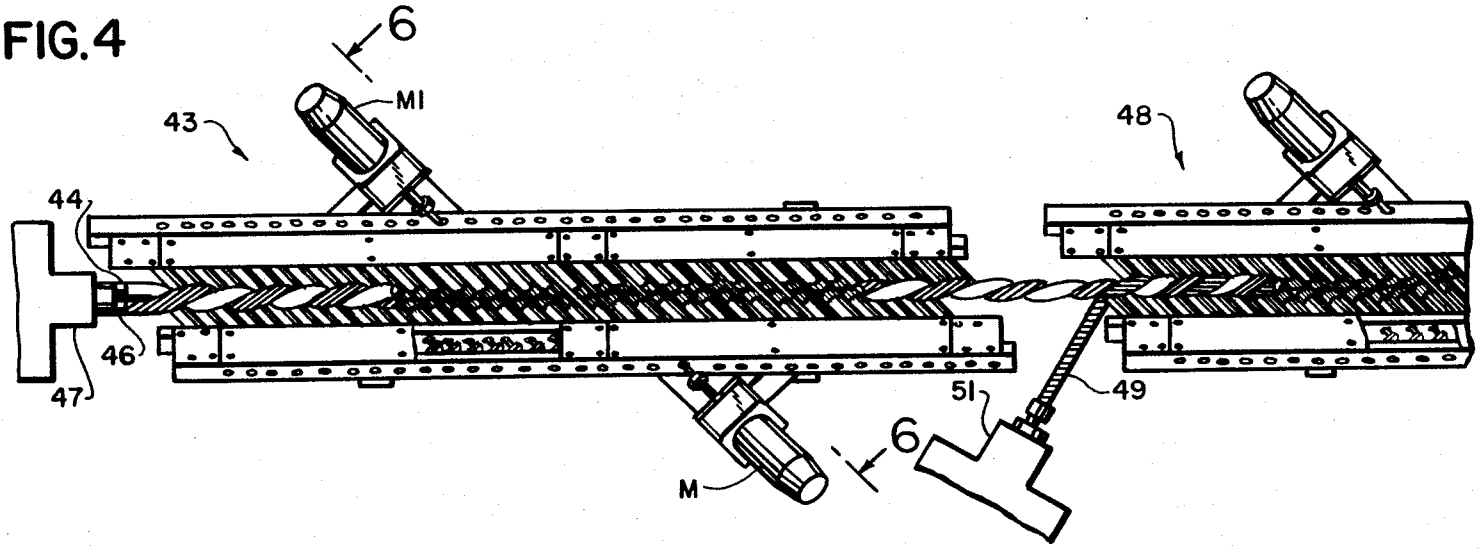
FIG. 4 shows a second conveyor means in tandem with the conveyor means of FIG. 1.
Figure 5:
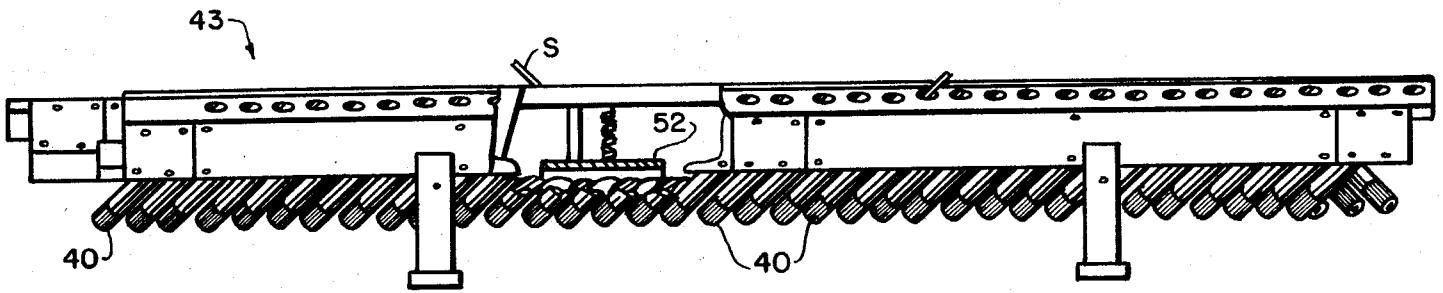
FIG. 5 is a view similar to FIG. 2 with portions broken away to show a pressure foot.

Referring to FIGS. 4, 5 and 6, a conveyor means 43 is shown receiving two generally parallel strands 44 and 46 emerging in this case from the crosshead 47 of an extruder (not shown).

The strands are twisted and advanced with a left-hand lay at a pitch of approximately 3-5/32 inches.

The output of the conveyor means 43 is fed into a similar tandem conveyor means 48 at whose inlet end a third strand 49 is introduced from crosshead 51.

Operation of tandem conveyor means 48 is effective to combine and twist third strand 49 into the rope emerging from conveyor means 43 to develop a three-strand line as is apparent in the cross-section of FIG. 6.

Obviously, a number of conveyor means can be arranged in series, each receiving one or more strands to generate a multi-strand rope.

Furthermore, it is anticipated that the strand material can take a variety of forms such as dough-like filaments, plastic strands, insulated wire, or other ribbons or filamentary lengths of material.

Frequently it is necessary to increase friction between the strand material and the rollers. One method of increasing friction is to provide a roughened or knurled surface on the rollers, as at 40 (FIG. 1), or to utilize a pressure device or a pressure foot, as indicated by the reference numeral 52 in FIG. 5.

Such a device is resilient, adjustable and usually spring-loaded to bear upon the twisting strand to regulate friction between the strands and the rollers.

It is anticipated that a wide variety of modifications may be devised in the method and apparatus of the present invention without departing from the spirit and scope thereof.

What is claimed is:

1. A method of advancing and twisting a plurality of generally parallel, endless strands into a rope configuration comprising the steps of providing a conveyor means having at least two side walls, one side wall defining a series of side-by-side rollers, skewing a rotational axis of each roller to a predetermined angular position relative to horizontal and vertical planes, rotating the rollers in unison about their axes in a predetermined direction, feeding said strands into said conveyor means and into frictional contact with said rollers whereby the rollers by virtue of their skewed disposition and direction of rotation are effective to develop two force components, one component operating to twist the strands into a rope while the other component operates to advance the twisted strands through the conveyor means.

2. The method of claim 1 in which the side walls define a V-shape configuration in cross-section.

3. The method of claim 1 plus the step of knurling a portion of each said roller to increase friction between the rollers and the strands.

4. The method of claim 1 plus the step of maintaining the linear speed of advance of said parallel strands as necessary to develop a uniform lay and pitch in the twisted strands emerging from said conveyor means.

5. The method of claim 1 plus the step of providing a second series of rollers in the second side wall.

6. The method of claim 5 plus the step of skewing the axes of said rollers of said second side wall relative to horizontal and vertical planes to enhance the twisting and advancing motion of said strands in said conveyor means.

7. The method of claim 6 plus the step of rotating said rollers in said second side wall in unison and in a direction so as to further enhance the twisting and advancing motion of said strands.

8. The method of claim 7 plus the step of rotating both series of rollers in a direction so as to create a lay of a predetermined "hand" or direction in said twisted strands.

9. The method of claim 8 plus the step of rotating both series of rollers at substantially the same speed.

10. The method of claim 9 plus the step of providing a pressure foot or shoe in the conveyor means and above the strands to increase friction between the strands and the rollers.

11. The method of claim 1 plus the steps of providing a second conveyor means, feeding the output of the first conveyor means to the second conveyor means and introducing at least one additional strand at the inlet of said second conveyor means whereby said additional strand is twisted about and combined with said plurality of strands consistent with the lay of said plurality of strands.

12. A conveyor means for simultaneously advancing and twisting a plurality of strands into a rope, comprising an elongated trough having at least two walls joined to define a linear path, a first wall including a plurality of aligned rollers having axes of rotation bearing a predetermined angular relationship relative to horizontal and vertical planes, power means for driving said rollers in unison in a predetermined direction, and means for feeding said strands into said trough and into frictional contact with said rollers, said rollers being effective, by virtue of their angular position and direction of rotation, to advance the strands while twisting the strands into a rope.

13. The conveyor means of claim 12 in which both walls include a plurality of parallel rollers.

14. The conveyor means of claim 13 in which the rotational axes of the rollers of a second wall are disposed so as to enhance the twisting action of said one wall.

15. The conveyor means of claim 14 including power means for driving the rollers of the second wall.

16. The conveyor means of claim 15 in which the power means for driving the rollers of the first wall and the power means for driving the rollers of the second wall are set to generate a uniform lay in the twisted strands.

17. The conveyor means of claim 16 including control means for changing the rotational speed of said rollers effective to vary the pitch or turns per unit length of rope.

18. The conveyor means of claim 12 in which the trough includes a resilient shoe or pressure foot operative to bear upon advancing strands to enhance friction between the strands and the rollers.

19. The conveyor means of claim 12 in which the rollers are formed with a knurled or roughened surface to enhance friction.

20. The conveyor means of claim 12 in which a second conveyor means is disposed at the discharge end of the first conveyor means to receive the rope output of the first conveyor means and means for advancing at least one additional strand into said second conveyor means, said second conveyor means being effective to twist said additional strand about said rope.

* * * * *